US008943754B2

(12) United States Patent
Brensinger

(10) Patent No.: US 8,943,754 B2
(45) Date of Patent: Feb. 3, 2015

(54) BENDING MECHANISM FOR AIR-BEAMS

(71) Applicant: Nemo Equipment, Inc., Dover, NH (US)

(72) Inventor: Cam Brensinger, Stratham, NH (US)

(73) Assignee: Nemo Equirment, Inc., Dover, NH (US)

( * ) Notice: Subject to any disclaimer, the term of this patent is extended or adjusted under 35 U.S.C. 154(b) by 0 days.

(21) Appl. No.: 13/854,410

(22) Filed: Apr. 1, 2013

(65) Prior Publication Data

US 2014/0000178 A1 Jan. 2, 2014

Related U.S. Application Data

(63) Continuation-in-part of application No. 12/920,702, filed as application No. PCT/US2008/057682 on Mar. 20, 2008, now abandoned.

(60) Provisional application No. 60/895,771, filed on Mar. 20, 2007.

(51) Int. Cl.
*E04H 15/20* (2006.01)
*E04C 3/00* (2006.01)

(52) U.S. Cl.
CPC ..... *E04C 3/005* (2013.01)
USPC ..... 52/2.18; 52/2.11

(58) Field of Classification Search
CPC ..... E04H 1/00; E04H 15/00; E04H 15/008; E04H 15/24; E04H 15/32
USPC ..... 52/2.11, 2.13, 2.14, 2.16, 2.18, 2.19, 52/2.21, 2.22, 2.23, 2.25
See application file for complete search history.

(56) References Cited

U.S. PATENT DOCUMENTS 4,876,829 A 10/1989 Mattick
5,007,212 A * 4/1991 Fritts et al. ..... 52/2.18
5,110,666 A * 5/1992 Menzel et al. ..... 428/196
5,178,938 A * 1/1993 Magistro et al. ..... 442/261

(Continued)

FOREIGN PATENT DOCUMENTS

WO WO 8600952 A1 * 2/1986 ..... E04H 15/20

OTHER PUBLICATIONS

International Search Report for PCT/US08/057682, US PTO, Jun. 4, 2009.

(Continued)

*Primary Examiner* — Mark Wendell
*Assistant Examiner* — Keith Minter
(74) *Attorney, Agent, or Firm* — Bourque and Associates, PA

(57) ABSTRACT

A bending mechanism for an airbeam is located inside an outer member that defines the airbeam. The outer member creates an air containing region. A bending element defines a bending region and to which is attached two opposing portions of the inner surface of the outer member. The bending component defines two air containing regions in the airbeam and includes an air conducting path that is disposed within the bending region. The air conducting path is fluidly connected to the air containing regions on both sides of the bending region and is configured for allowing the airbeam to be bent and arranged in two planes at the bending region while allowing air to be inserted into the airbeam at one inflation point. Therefore, the air-conducting member allows air to flow from one air containing region to another air containing region on opposite sides of the bending region.

12 Claims, 3 Drawing Sheets

(56) References Cited

U.S. PATENT DOCUMENTS

| | | | | |
|---|---|---|---|---|
| 5,761,852 | A * | 6/1998 | Liu | 52/2.18 |
| 5,884,646 | A | 3/1999 | Ju | |
| 5,893,237 | A * | 4/1999 | Ryon et al. | 52/2.18 |
| 5,893,238 | A * | 4/1999 | Peacock et al. | 52/2.18 |
| 5,987,822 | A * | 11/1999 | McNiff et al. | 52/2.11 |
| 6,029,404 | A * | 2/2000 | Lewis | 52/2.18 |
| 6,167,898 | B1 * | 1/2001 | Larga et al. | 135/137 |
| 6,192,633 | B1 * | 2/2001 | Hilbert | 52/2.18 |
| 6,239,046 | B1 * | 5/2001 | Veiga et al. | 442/76 |
| 6,260,306 | B1 * | 7/2001 | Swetish et al. | 52/2.18 |
| 6,263,617 | B1 * | 7/2001 | Turcot et al. | 52/2.18 |
| 6,350,709 | B1 * | 2/2002 | Veiga | 442/71 |
| 6,455,449 | B1 * | 9/2002 | Veiga et al. | 442/218 |
| D482,423 | S * | 11/2003 | Newsome | D21/835 |
| 6,641,686 | B1 * | 11/2003 | Veiga et al. | 156/73.1 |
| 6,645,565 | B2 * | 11/2003 | Veiga | 427/407.1 |
| 6,740,607 | B2 * | 5/2004 | Veiga et al. | 442/149 |
| D510,118 | S * | 9/2005 | Smith | D21/834 |
| 7,178,483 | B2 * | 2/2007 | Wu | 119/498 |
| 7,231,739 | B2 * | 6/2007 | Scherba | 52/2.18 |
| 7,543,594 | B2 * | 6/2009 | Novak | 135/116 |
| 7,611,148 | B2 * | 11/2009 | Caswell | 273/400 |
| 7,651,118 | B1 * | 1/2010 | Veiga | 280/728.1 |
| 7,926,225 | B2 * | 4/2011 | Pedretti | 52/2.18 |
| 8,079,182 | B1 * | 12/2011 | Higgins | 52/2.11 |
| 8,166,711 | B2 * | 5/2012 | Lamke | 52/2.18 |
| 8,499,500 | B2 * | 8/2013 | Lamke | 52/2.18 |
| 8,615,966 | B2 * | 12/2013 | Thompson | 52/745.19 |
| 2002/0083653 | A1 | 7/2002 | Hilbert | |
| 2003/0003833 | A1 * | 1/2003 | Kurihara et al. | 442/394 |
| 2004/0042965 | A1 * | 3/2004 | Usui et al. | 424/40 |
| 2004/0261324 | A1 * | 12/2004 | Tewari | 52/2.18 |
| 2008/0001431 | A1 * | 1/2008 | Thompson et al. | 296/187.01 |
| 2008/0190472 | A1 * | 8/2008 | Turcot | 135/126 |
| 2008/0295417 | A1 * | 12/2008 | Turcot | 52/2.13 |
| 2008/0313970 | A1 * | 12/2008 | Turcot | 52/2.18 |
| 2009/0249701 | A1 * | 10/2009 | Turcot | 52/2.18 |
| 2010/0129575 | A1 * | 5/2010 | Veiga | 428/35.4 |
| 2010/0175330 | A1 * | 7/2010 | Turcot | 52/2.11 |
| 2013/0189507 | A1 * | 7/2013 | Yamamoto et al. | 428/219 |
| 2014/0072751 | A1 * | 3/2014 | Bradenburg | 428/41.8 |

OTHER PUBLICATIONS

Written Opinion of International Searching Authority for PCT/US08/057682, US PTO, May 21, 2009.

* cited by examiner

BENDING MECHANISM FOR AIR-BEAMS

CROSS-REFERENCE TO RELATED APPLICATIONS

This application is a continuation-in-part of U.S. patent application Ser. No. 12/920,702 titled "Outdoor Equipment" filed on Sep. 2, 2010 and claims priority from PCT Application PCT/US2008/057682 titled "Outdoor Equipment" filed on Mar. 20, 2008 and U.S. Provisional Application Ser. No. 60/895,771 titled "Outdoor Equipment" which was filed on Mar. 20, 2007, all of which are incorporated fully herein by reference.

TECHNICAL FIELD

The present invention relates to inflatable structures and more particularly, relates to a bending and joining mechanism for air-inflated beams utilized for building or supporting huts, tents, lodges, bridges or any other structures and/or for making other items such as chairs and the like.

BACKGROUND INFORMATION

Air-inflated beams or airbeams have been used to create a variety of structures including tents, shelters, and hangars. Some of the current airbeam configurations include a large number of inflation points, which has been found to be undesirable because the large number of inflation points creates an overly complicated assembly process. Additionally, many prior art embodiments feature an airbeam structure that requires a base and/or tent shell material in order to support the structure.

In various configurations, one or more airbeams may be used to support a structure, such as a tent. For example, a single airbeam may form two "legs" of a structure. Two airbeams may be used to form four "legs". In prior designs that featured two or more airbeams, the airbeams had to cross over one another, forming an "X" design. Although standard tent poles typically cross over one another without an issue, when using airbeams the crossing over of one airbeam with another airbeam creates a very bulky design. The crossing of the airbeams creates a loss of headroom, which becomes even more of a problem as three or more airbeams are crossed. Therefore, there is a need for a device that enables bending and/or coupling of the airbeams to be achieved at specific locations, such that two or more airbeams can be coupled to one another within the same plane, without loss of headroom. The device should also enable the entire multiple airbeam structure to be inflated from a single inflation point and should also allow the airbeam structure to be free standing.

SUMMARY

The present invention is a bendable airbeam having a mechanism for allowing the airbeam to be bent and when desired, arranged in at least two planes and wherein two airbeams may be coupled together. The bendable airbeam includes a generally planar airbeam with a length and width. The planar airbeam is defined by an outer member with an inner surface and an outer surface. The outer member contains a generally open, internal, air-containing region.

The bendable airbeam also includes at least one airbeam bending mechanism disposed within the airbeam. This bending mechanism defines an airbeam bending region that includes a portion of the inner surface of the outer member, the bending mechanism and a portion of the inner surface attached together in a generally linear direction and generally perpendicular to the length of the airbeam. The bending mechanism is disposed between at least two airbeam air-containing regions. The airbeam air-containing region is disposed on one side of the bending region and the second airbeam air-containing region is disposed on the other side of the bending region.

The airbeam bending mechanism further includes an air-conducting member that is disposed within the bending region, allowing airflow generally along the length of the airbeam and attached to the inner surface of the airbeam at the bending region. The air-conducting member is fluidly connected to the first and second air-containing regions and is configured for allowing the airbeam to be bent and arranged in two planes at the bending region, when desired, while allowing air to flow from the first air-containing region to the second air-containing region both located on different sides of the bending region. This airflow is especially important at the time of inflation. Because the airbeams of the present invention include bending regions with air-conducting members between each air-containing region, they can be inflated using a single inflation point and the problems associated with crimping during inflation are minimized.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The present invention provides a mechanism for controllable bending of a single-walled airbeam and coupling of two or more airbeams containing such a mechanism together. This mechanism allows for the creation of structures supported by multiple airbeams with a minimal number of inflation points, and thereby increases the convenience and speed of setup.

Figure 1:
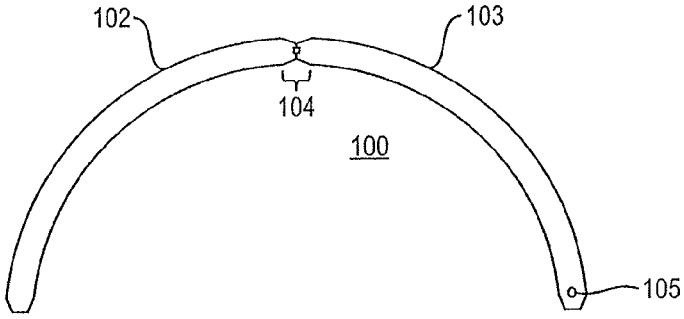
FIG. 1 is a front view of an airbeam incorporating the internal bending mechanism of the present invention.
Figure 2:
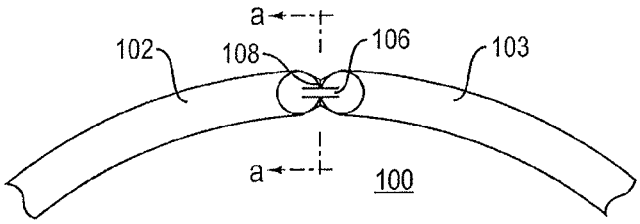
FIG. 2 is a close-up view of the internal bending mechanism of the present invention disposed within an airbeam.
Figure 3:
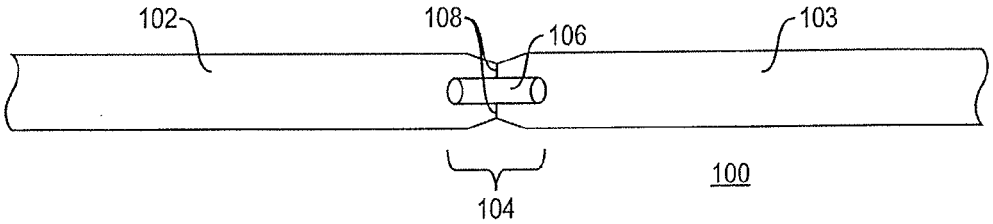
FIG. 3 is a cross-sectional view of the internal bending mechanism taken along line a-a of FIG. 2.

An exemplary airbeam 100, FIG. 1, includes a first airbeam segment 102, a second airbeam segment 103 and a bending region 104 preferably at or near a center or midpoint of the airbeam 100 and a single inflation point 105, although the location of the bending region 104 is not intended to be a limitation of the present invention. As shown in FIGS. 2 and 3, this bending region 104 is created by placing an air-conducting member 106, such as a short piece of hard tubing or a mechanism **106*a* shown in FIG. 7 as will be described later herein, into the bending region 104 of the airbeam 100. The tubing material may be composed of either rigid or semi-rigid material such as rubber or thermoplastic as long as an air passage can be formed and generally maintained. The air-conducting member 106 may also be made of a mostly solid material having a plurality of air channels within it as will be explained further below. The air-conducting member 106 may also be made from polyurethane or another material that can easily be heat welded to the material of the inner surface of the airbeam 100. The air-conducting member 106 is provided in a central area of the bending region 104 of the airbeam in order to maintain airflow through the airbeam 100 even when the first and second airbeam segments 102,103 are folded or bent slightly. The air-conducting member 106 may be attached to the insides of at least two sections of airbeam material. This attachment location allows for inflation of the entire volume of the airbeam (i.e. both the first and second airbeam segments) from a single point. In another embodiment of the present invention, the air-conducting member 106 is attached to the inner surface of the airbeam material at a location other than middle center or midpoint area. The function that is carried out by the air-conducting member 106 is independent of the location where it is disposed, i.e. the air-conducting member 106 can facilitate bending and inflation no matter where the air-conducting member 106** is located.

In the first embodiment, two or more small, horizontal weld lines 108, FIGS. 2 and 3, are made on the center seam directly above and below where the air-conducting member 106 is inserted. There are a variety of bonding processes that may be utilized depending on the fabric or material used for the structure. It is preferable to use a welding process, such as impulse sealing or radio frequency welding, for TPU-coated fabrics in order to create clean weld lines. However, other bonding processes may be utilized such as chemical bonding or heat bonding.

Figure 4:
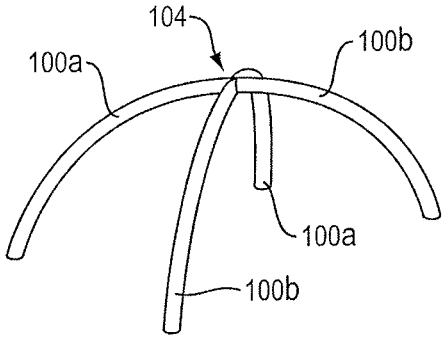
FIG. 4 is a perspective view of two airbeams incorporating the internal bending mechanism of the present invention, each bent and coupled together.

Two ore more airbeams 100*a* and 100*b*, FIG. 4, may be bent and placed proximate or against one another to form four or more "legs" for supporting a structure. In addition, the airbeams 100*a* and 100*b* may be bent at any angular orientation, ranging from nearly linear or straight configurations to configurations with almost no separation of the beam ends (bent nearly 180 degrees).

Figure 5:
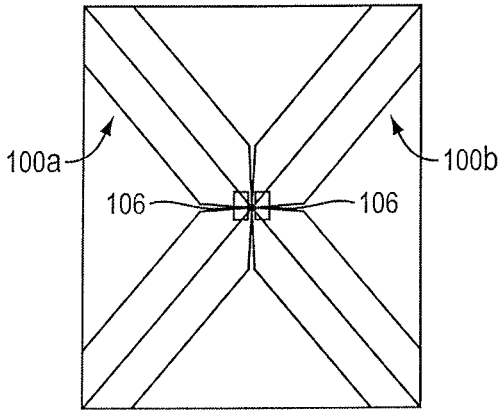
FIG. 5 is a close-up view showing two bent airbeams coupled together.
Figure 6:
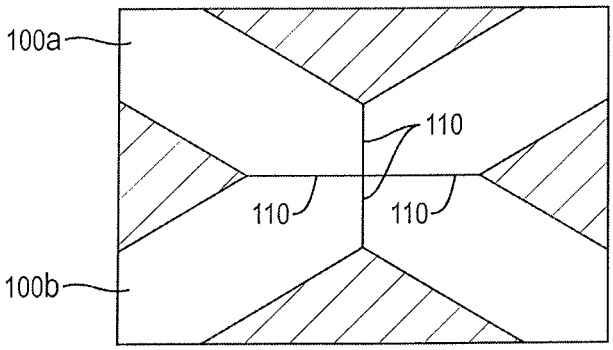
FIG. 6 is a plan view of connecting ties between two bent airbeams.

Each airbeam 100 includes an air-conducting member 106, FIG. 5, which is disposed to allow airflow between adjacent airbeam sections (for example, from a first airbeam segment 102 to a second airbeam segment 103). The multiple airbeams 100*a* and 100*b* that utilize the bending configuration of the invention may be combined by a tying or coupling mechanism 110, FIG. 6, which connects the airbeams 100*a* and 100*b* together at a bending region 104 to create various configurations. The tying mechanism 110 is preferably a connecting tie that attaches the airbeams 100*a* and 100*b* together at the bending region 104.

Figure 7:
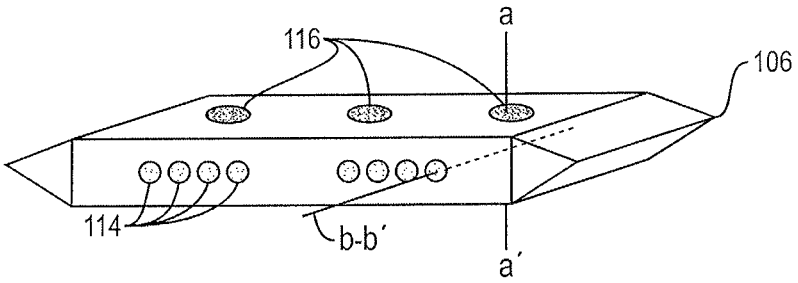
FIG. 7 is a perspective view of an air-conducting member.

FIG. 7 illustrates a preferred embodiment of an air-conducting member 106 which includes one or more vertically oriented passages 116 disposed to allow the connection or coupling of more than one airbeam 100. According to this aspect of the invention, the air-conducting member 106 includes one or more horizontally oriented passages 114 that allow air to flow from a first airbeam segment 102 to a second airbeam segment 103 of the airbeam 100 parallel to axis b-b'. Vertically oriented passages 116 oriented along axis a-a' allow interconnection of two or more bendable airbeams 100*a*, 100*b*, etc. Vertically oriented passages 116 are preferably perpendicular to the orientation of the horizontally oriented passages 114 although other orientations are within the scope of the present invention.

Figure 8:
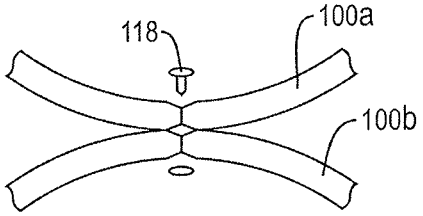
FIG. 8 is a perspective view of two air-conducting members attached with a coupling means.
Figure 9:
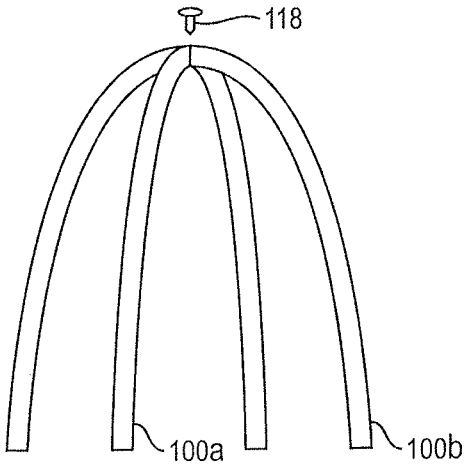
FIG. 9 is yet another perspective view of two air-conducting members attached with a coupling means.

FIGS. 8 and 9 illustrate two bendable airbeams 100 tied together through the air-conducting member 106 via the vertically oriented passages 116 using an attachment mechanism 118, such as a nut and bolt or other similar mechanism. The bendable airbeams 100 are not shown in their entirety for the sake of clarity, but would be connected to the air-conducting members 106 as shown and described herein. The vertically oriented passages 116 traversing the air-conducting member 106 may or may not also pass through the material used to fabricate the airbeams to the outside. The material may be welded to the air-conducting member 106 either at the ends of sections of material, or in the middle of the material and vertically oriented passages 116 traversing the air-conducting member 106 will not alter the air-tight quality of the airbeam 100 as the airbeam material can be welded to the air-conducting members 106 around the passages 112, thereby maintaining the air seal. Also note that while two air-conducting members 106 are shown connected perpendicular to one another, other orientations and greater numbers of air-conducting members 106 are within the scope of the present invention.

For example, it is contemplated and within the scope of the present invention that three or more airbeams may be connected to one another. In this example, multiple bends in the airbeams may occur at both upper and lower portions of a structure. This design may also be accomplished by one long airbeam, which features a plurality of bending locations, thereby creating a multiple leg structure with a singular airbeam. Whether the design features a singular airbeam or a plurality of airbeams, the design may feature only a single inflation point, thereby reducing the complexity of inflating the structure.

Accordingly, the present invention provides a structure that includes an airbeam with a bending region that further includes an air-conducting member disposed within the bending region allowing for air to flow from one air-containing region to at least one other air-containing region, eliminating the need for multiple inflation points in a bent airbeam as well as providing an element to join multiple airbeams together.

Modifications and substitutions by one of ordinary skill in the art are considered to be within the scope of the present invention, which is not to be limited except by the allowed claims and their legal equivalents.

The invention claimed is:

1. A bendable airbeam including a mechanism for allowing the airbeam to be bent, said bendable airbeam comprising:

a planar airbeam having a length and a width, said airbeam defined by an outer member having an inner and an outer surface, said outer member creating an open internal air-containing region;

at least one airbeam bending mechanism having a first planar surface and a second planar surface disposed within said airbeam, said at least one airbeam bending mechanism defining an airbeam bending region including first and second opposing portions of said inner surface of said outer member attached to said first and second planar surfaces of said opposing inner surfaces of said outer member in a linear direction perpendicular to said length of said airbeam, and configured for defining at least two airbeam air containing regions, a first of said at least two airbeam air containing regions disposed on a first side of said airbeam bending region and a first side of said at least one airbeam bending mechanism, and a second of said at least two airbeam air containing regions disposed on a second side of said airbeam bending region and a second side of said at least one airbeam bending mechanism, said at least one airbeam bending mechanism further including at least one air conducting path, said air conducting path fluidly connecting said first of said at least two airbeam air containing regions and said second of said at least two airbeam air containing regions and configured for allowing said airbeam to be bent and arranged in two planes at said airbeam bending region, while allowing air to flow from said first of said at least two airbeam air containing region disposed on said first side of said airbeam bending region and said first side of said at least one airbeam bending mechanism to said second of said at least two airbeam air containing region disposed on said second side of said airbeam bending region and said second side of said at least one airbeam bending mechanism through said air conducting path of said airbeam bending mechanism.

2. The bendable airbeam of claim 1, wherein said outer member is composed of a material whose inner surface may be attached to said at least one airbeam bending mechanism by a method selected from the group of methods consisting of a chemical bonding method, a heat bonding method and an RF bonding method.

3. The bendable airbeam of claim 1, wherein said air conducting path includes a hollow rigid tube.

4. The bendable airbeam of claim 1, wherein said air conducting path is made from a flexible material.

5. The bendable airbeam of claim 1, wherein said air-conducting path is solid with a plurality of air passages therethrough.

6. The bendable airbeam of claim 1, wherein said at least one airbeam bending mechanism is fastened to said inner surface of said outer member.

7. The bendable airbeam of claim 1, wherein said at least one airbeam bending mechanism is fastened to said inner surface of said outer member by welding.

8. The bendable airbeam of claim 1, wherein said at least one airbeam bending mechanism is comprised of polyurethane.

9. The bendable airbeam of claim 1, wherein said at least one airbeam bending mechanism includes a tying mechanism.

10. The bendable airbeam of claim 9, wherein said at least one airbeam bending mechanism has a top surface and a bottom surface and wherein said tying mechanism comprises a passage through said at least one airbeam bending mechanism from said top surface to said bottom surface.

11. The bendable airbeam of claim 1, comprising an inflation point.

12. The bendable airbeam of claim 10 further including a second planar airbeam coupled to said planar airbeam through said interconnect passage through said planar airbeam and through said interconnect passage through said second planar airbeam.

* * * * *